US005224719A

United States Patent [19]

Goodspeed

[11] Patent Number: 5,224,719

[45] Date of Patent: Jul. 6, 1993

[54] SKATEBOARD

[76] Inventor: Byron L. Goodspeed, 203 White Rd., Castle Rock, Wash. 98611

[21] Appl. No.: 883,558

[22] Filed: May 15, 1992

[51] Int. Cl.[5] ..... B62M 1/04

[52] U.S. Cl. ..... 280/11.115; 280/221; 280/87.042

[58] Field of Search ..... 280/11.115, 220, 221, 280/87.042, 87.041, 253, 257, 258

[56] References Cited

U.S. PATENT DOCUMENTS

| | | | |
|---|---|---|---|
| 525,270 | 8/1894 | Kitchen | 280/11.115 |
| 732,120 | 6/1903 | Schmidt | 280/11.115 |
| 3,285,618 | 11/1966 | Welch | 280/11.115 |
| 4,602,801 | 7/1986 | Vincent | 280/11.115 |
| 4,861,054 | 8/1989 | Spital | 280/11.115 |
| 4,915,403 | 4/1990 | Wild et al. | 280/221 |

FOREIGN PATENT DOCUMENTS

| | | | |
|---|---|---|---|
| 807791 | 4/1951 | Fed. Rep. of Germany | 280/11.115 |
| 13252 | 5/1910 | Sweden | 280/11.115 |
| 297879 | 4/1954 | Switzerland | 280/11.115 |

*Primary Examiner*—Richard M. Camby
*Attorney, Agent, or Firm*—Dellett, Smith-Hill and Bedell

[57] ABSTRACT

A skateboard having a deck; a frame mounted under the deck; a pedal pivotally mounted to the frame substantially below the deck and adjacent a forward portion of the deck; a plurality of wheels and clutch bearing retaining drive wheels rotatably mounted to substantially conventional diagonal axis steering trucks on the underside of the deck; a block having grooves therein and mounted underneath the deck; transmission member comprising a rack with two members having upwardly facing portions slidable within the grooves in the block and downwardly facing toothed portions for driving pinions rotatably mounted to the frame, the pinions driving pulleys having clutch bearings therein and also rotatably mounted to the frame, the pulleys being operably connected to drive wheels by loops of flexible belt material of circular cross section on either side of steering axes such that depression of the pedal reciprocates the rack members via a roller engagement between the rack and the pedal to impart rotational motion to the drive wheels; and spring return member for biasing the rack and the pedal toward their ready positions when the pedal is not depressed. In a second embodiment, a modified transmission member is provided wherein a similar rack is reciprocable along a system of rollers and is linked to a cammed surface to provide variable speed output over the range of pedal depression.

10 Claims, 9 Drawing Sheets

SKATEBOARD

CROSS-REFERENCE TO RELATED APPLICATION

This application is related to application Ser. No. 07/883,557, entitled SKATEBOARD, and filed concurrently herewith.

FIELD OF THE INVENTION

The present invention relates generally to vehicles propelled by the rider of the vehicle and more particularly to a skateboard having an actuable pedal for propelling the same.

BACKGROUND OF THE INVENTION

Skateboard riders propel their skateboards, at least on flat or uphill surfaces, by assuming a pushing stance in order to thrust against the ground with one foot while the other foot is positioned on the board. Then, while coasting and maneuvering, a skateboarder places both feet on the board deck in a riding stance, facing sideways relative to the movement of the skateboard, one foot on a front portion of the board and the other foot at the rear. Steering of the skateboard is typically accomplished by the rider leaning laterally with respect to the direction of travel to one side or the other in order to tilt the board. The tilt is converted into a corresponding change of direction of the wheels via front and rear steering trucks. Conventional steering trucks have an axle fixed thereto with wheels mounted for rotation in fixed planes perpendicular to the axle, and employ steering axes diagonally positioned in opposing directions with respect to the vertical (i.e., with the steering axis of one truck angled forwardly and the steering axis of the other truck angled rearwardly) whereby lateral tilting relative to the axles causes the trucks to rotate and steer in the desired direction.

Disadvantages associated with the conventional method of propulsion on flat ground include the fact that additional speed or propulsion is achieved by temporarily leaving the riding stance with two feet on the board to assume the pushing stance with one foot on the board and one foot on the ground. The speeds attainable with such a method are limited. This and other factors have led to efforts at developing pedal-powered skateboards directed toward avoiding the need for alternating between conventional riding and pushing positions.

One prior skateboard as described in U.S. Pat. No. 4,915,403 employs an actuable pedal hinged to the chassis of the skateboard near the middle of the board such that the pedal inclines upwardly from the hinge, the pedal comprising the rear half of the board. During propulsion and riding, one of the rider's feet is positioned on the front portion of the board while the remaining foot presses the actuable pedal downwardly. The motion of pushing the actuable pedal downwardly is transmitted to drive wheels having an overrunning clutch via an elastically mounted push rod used to drive a gear train mounted under the board. The pedal is returned to an elevated position ready for the next stroke by a spring. Though steering of such a board is accomplished according to somewhat conventional diagonal steering axis means, a modified rear truck is required.

Another prior skateboard as set forth in U.S. Pat. No. 4,861,054 uses a pair of actuable pedals, one pedal for each of the rider's feet, wherein each pedal comprises one half of the board surface. The pedals of such skateboard are pivoted to a chassis, and propulsion is accomplished by pushing either or both of the pedals downwardly. Separate push rods for each pedal, drive gears, chain loops and sprockets mounted on shafts in a power transmission train are employed in order to impart rotational motion to a drive wheel. Once the rider's weight has been removed from either or both of the pedals, a spring return system counter-rotates the gears on overrunning clutch bearings to return the pedal or pedals to a ready position. Steering is accomplished by tilting the board from side-to-side, as with conventional boards, but unlike conventional boards the tilting of the board is translated into independent turning of front wheels through a system of steering rods and a rocking pendulum.

An alternative embodiment of the dual pedal propulsion skateboard described in U.S. Pat. No. 4,861,054 employs a relatively wide drive belt running over a system of rollers, the drive belt being fixed near its middle to a center piece of the board and at each end to front and rear drive sleeves that retain one-way clutches for engaging the front and rear wheel axles. Upon depressing, for example, the front pedal, a roller rotatably fixed to the pedal pulls the front portion of the drive belt over other rollers so that the drive belt unwinds from the front drive sleeve causing the front axle to turn drive wheels mounted on the axle. Upon release, the pedal is returned to an elevated position by a spring on the axle whereby the drive belt biases the pedal upwardly as the drive belt rewinds around the drive sleeve. Steering with this embodiment of the dual pedal propulsion skateboard is accomplished in a somewhat conventional manner.

One problem faced by the prior skateboards has been the accommodation of steering or turning and simultaneous propulsion of the wheels by pedal action. That is, there is difficulty in simply and effectively integrating a suitable propulsion system with an advantageous method of steering without producing an unwieldy or expensive board. Preferred conventional steering trucks fixed to the underside of the board have been replaced by complicated, bulky, and perhaps less stable or less efficient steering systems employing special linkages, steering rods, and swinging pendulums, or propulsion systems have been utilized which are difficult to manufacture or which heigthen the profile of the board, leading to instability. Maneuverability has also been a problem.

Another problem, unrecognized by the skateboards described above, is that depression of a single pedal or one of a pair of pedals comprising a rear portion of the board requires the rider to lean in a direction opposite the intended direction of travel of the board in order to supply the weight or force necessary. That is, with such boards, the motion of the rider is in a direction opposite that of the board and very unstable riding conditions can result. Thus, the board tends to "shoot out" from under the rider, especially when first starting to pedal the board.

Still another problem relates to the maximization of propulsion to permit acceleration without unduly elevating the board or inclining the pedal or pedals as would create an awkward or potentially unsafe or unstable riding condition. Attempts to deal with this problem have sometimes resulted in unduly bulky vehicles not closely resembling conventionally popular skateboards. Furthermore, some pedal-propelled skateboards have involved such a departure from conventional skateboards that converting a conventional skateboard to a pedal-propelled skateboard (e.g. with a kit) is not easily accomplished.

SUMMARY OF THE INVENTION

In accordance with the present invention, a skateboard is provided comprising an elongated deck, a pedal pivotally mounted to the deck and pivotable between a first ready position and a second depressed position, at least one drive wheel mounted to the underside of the deck and which includes an overrunning clutch bearing, a plurality of free spinning wheels also mounted on the underside of the deck, a linearly reciprocable rack that is movable with respect to the deck between a ready and a driven position and which is operably connected between the pedal and the drive wheel such that depression of the pedal provides rotational motion to the drive wheel to propel the skateboard, and a spring return means for biasing the linearly reciprocable rack and pedal toward their ready positions.

The invention is directed to a more efficient resolution of the problems associated with conventional propulsion requiring repositioning between pushing and riding stances. Additional speed of propulsion of the skateboard is achieved by depressing the pedal of the skateboard without the awkwardness of repositioning between pushing and riding positions.

Unlike prior pedal-powered skateboards, the skateboard according to the present invention operates in harmony with conventional steering trucks having diagonally positioned steering axes and without the necessity of unduly complicated linkages between the transmission of the skateboard and the drive wheel or wheels. Accordingly, the bulk, weight and height of the skateboard are minimized, and the maneuverability of the skateboard is improved.

In accordance with an aspect of the present invention, a frame is fixed to a deck, and the pedal of the skateboard is pivotally mounted to the frame at a location a substantial distance below the deck. This maximizes the force achieved for a given pedal stroke by effectively lengthening the pedal to increase the leverage of the pedal upon depressing it with one's foot. Moreover, the increased leverage is accomplished without unduly raising the height or incline of the pedal at its ready position. The center of gravity of the skateboard is lowered, and the stability of the skateboard is improved to prevent potentially hazardous riding conditions.

In accordance with another aspect of the invention, transmission of power is accomplished by depression of the pedal which is engaged by pedal rollers carried on a rack having horizontally disposed and interconnected members which linearly slide within grooves in blocks mounted to the underside of the deck. Teeth on the rack members drive a pair of pinions fixedly mounted to a shaft which rotates pulleys mounted on bearings carried by the shaft. Finally, the pulleys empower drive wheels by means of flexible belt loops of circular cross section extending on either side of a truck steering axis for interconnecting the pulleys each to a driver and clutch bearing combination operating a drive wheel. Since flexible belts of circular cross section are employed, an effective means of transmitting the power from depression of the pedal to the drive wheels is provided regardless of pivoting of the board relative to the steering trucks or the wheels relative to the board.

A second embodiment of the invention provides a pedal-powered skateboard having a transmission somewhat different from that described above. With this embodiment, the rack is not disposed entirely horizontally, but travels linearly along a system of rollers mounted on shafts carried between a frame mounted on the underside of the deck. Moreover, the pedal rollers providing engagement between the pedal and the rest of the transmission are rolled along a cammed surface upon depression of the pedal, the cammed surface being connected via a mechanical linkage to the rack. The rolling of the pedal rollers along the cammed surface and the positioning of the linkage between the cammed surface and the rack impart additional velocity to the rack at the bottom of the stroke, since the linkage and cammed surface are constructed such that the linkage is driven a greater distance with a smaller input by the pedal as the pedal rollers on the cammed surface are moved farther from the end of the cammed surface connected to the output linkage and closer to the end of the cammed surface about which the cammed surface pivots. Thus, higher speeds may be attained, and during higher speed riding only a small pedal stroke is required to maintain the higher speed.

Accordingly, it is an object of the present invention to provide an improved pedal-powered skateboard which overcomes many of the problems associated with prior skateboards, and particularly problems relating to integration of power transmission and steering, and maximization of propulsion and stability.

It is another object of the present invention to provide an improved pedal-powered skateboard adaptable for use with conventional steering trucks and which does not unduly alter their maneuverability, handling characteristics or transportability.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION OF THE DRAWINGS

Figure 4:
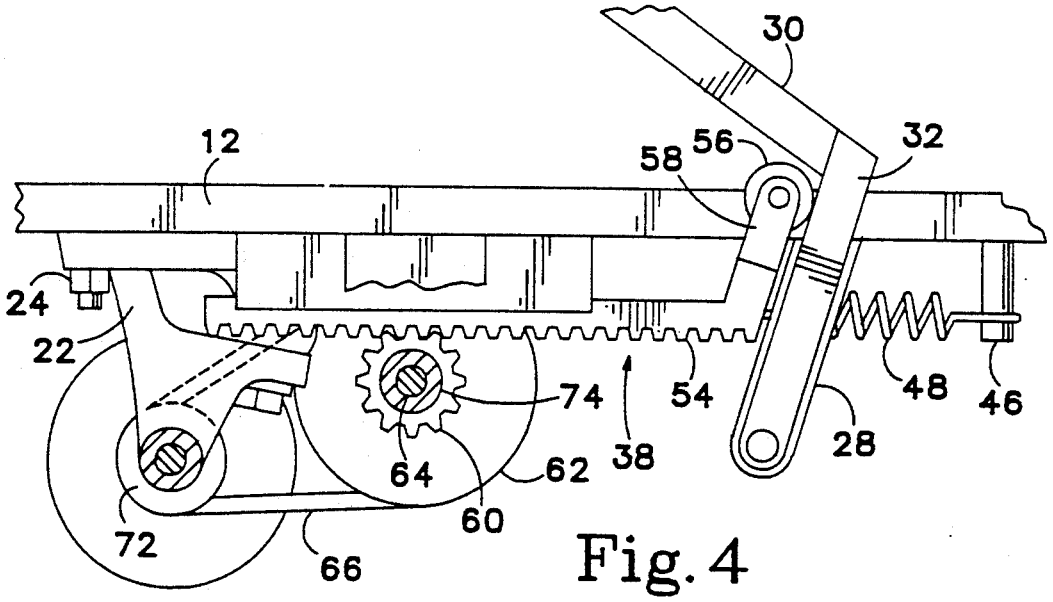
FIG. 4 is a partial section view taken along lines 4—4 of FIG. 3 with the pedal of the skateboard shown in a non-depressed or ready position.
Figure 5:
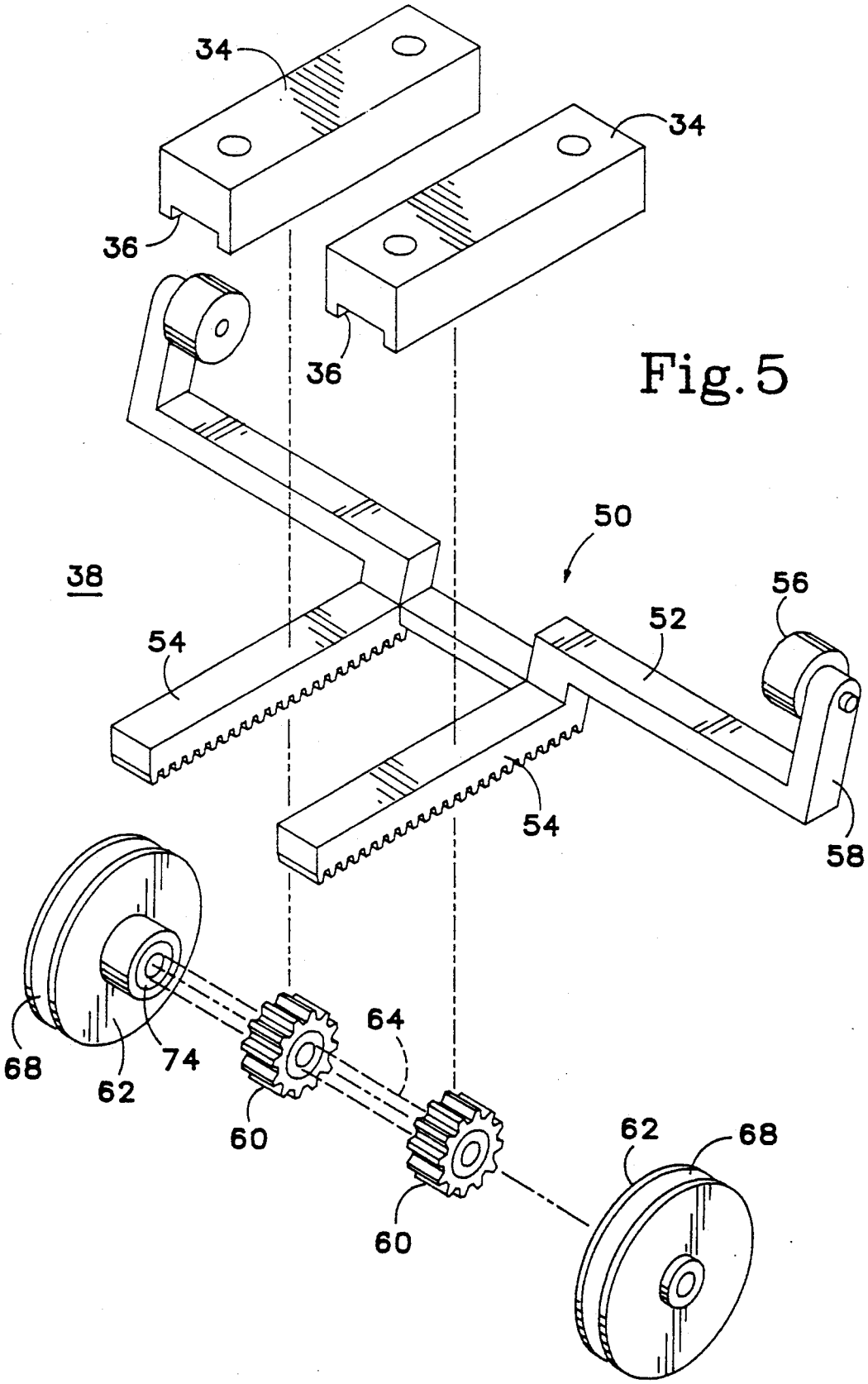
FIG. 5 is an exploded view of a portion of the transmission means of the skateboard shown in FIGS. 1 and 2 and blocks within which rack members of the transmission means reciprocate.

Referring to FIGS. 1-5, a first embodiment of a pedal powered skateboard 10 in accordance with the invention has a deck 12 with a pair of freespinning rear wheels 14 mounted on a diagonal axis . rear steering truck 16 attached to the underside of deck 12 with a plurality of nut and bolt combinations 18. A pair of front drive wheels 20 is similarly mounted on a diagonal axis front steering truck 22 that is also secured with nut and bolt combinations 24 to the underside of the deck. A frame preferably comprises a pair of brackets 28 which extend vertically downwardly at positions forward of the deck center and to the lower ends of which a pedal 30 is connected via pivotable pedal extensions 32. A pair of blocks 34 having grooves 36 defined therein are mounted to the underside of the deck 12 with screws or nuts and bolts. Transmission means 38, to be described in further detail below, is interposed in power transmitting relation between the pivotable pedal extensions 32 and front drive wheels 20. As described further below, the transmission means is positioned mostly beneath the level of the deck 12. Spring return means interconnects the transmission means 38 and a bracket 46 mounted on the underside of the deck and near the longitudinal center of the deck wherein spring 48 normally biases the transmission means and the pedal to a ready position as shown in FIG. 4.

Figure 6:
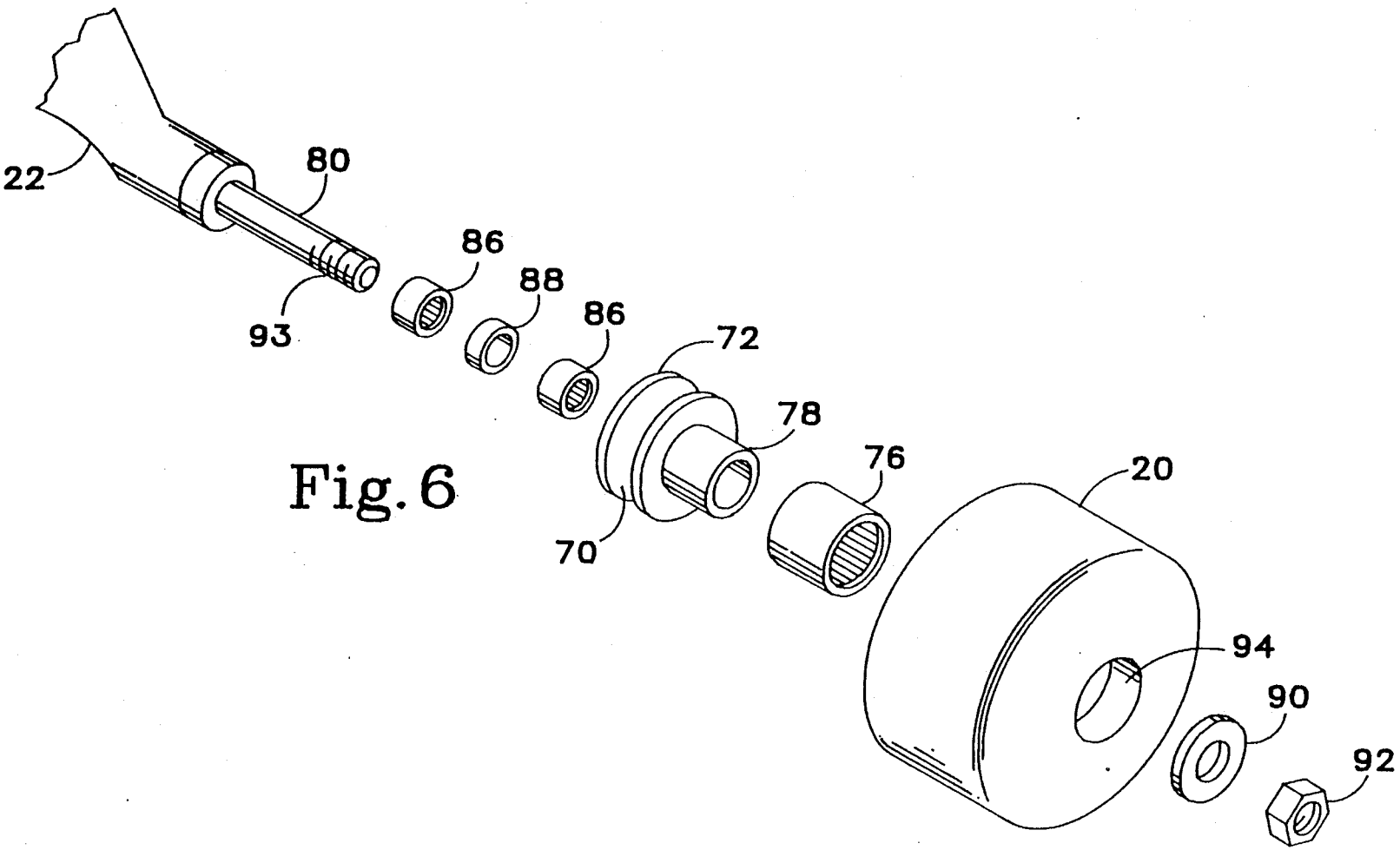
FIG. 6 is an exploded view of a drive wheel assembly and part of a steering truck.
Figure 7:
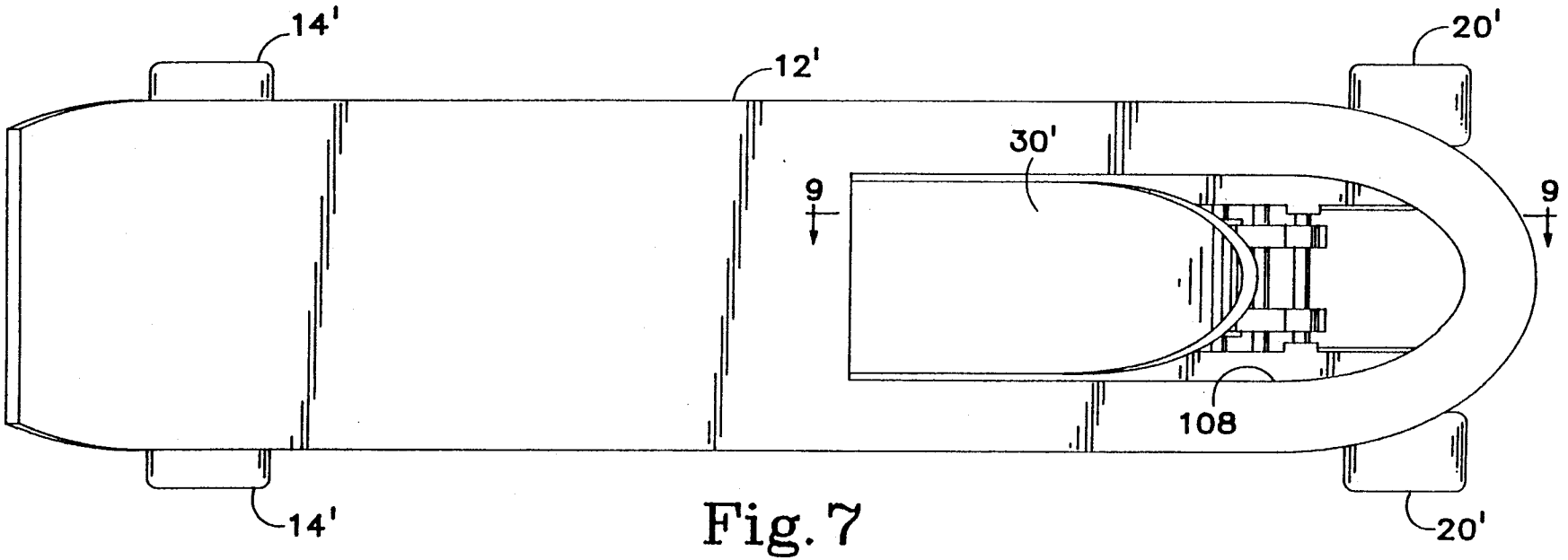
FIG. 7 is a top view of a pedal-powered skateboard in accordance with a second embodiment of the invention, wherein the pedal is in a non-depressed or ready position.
Figure 8:
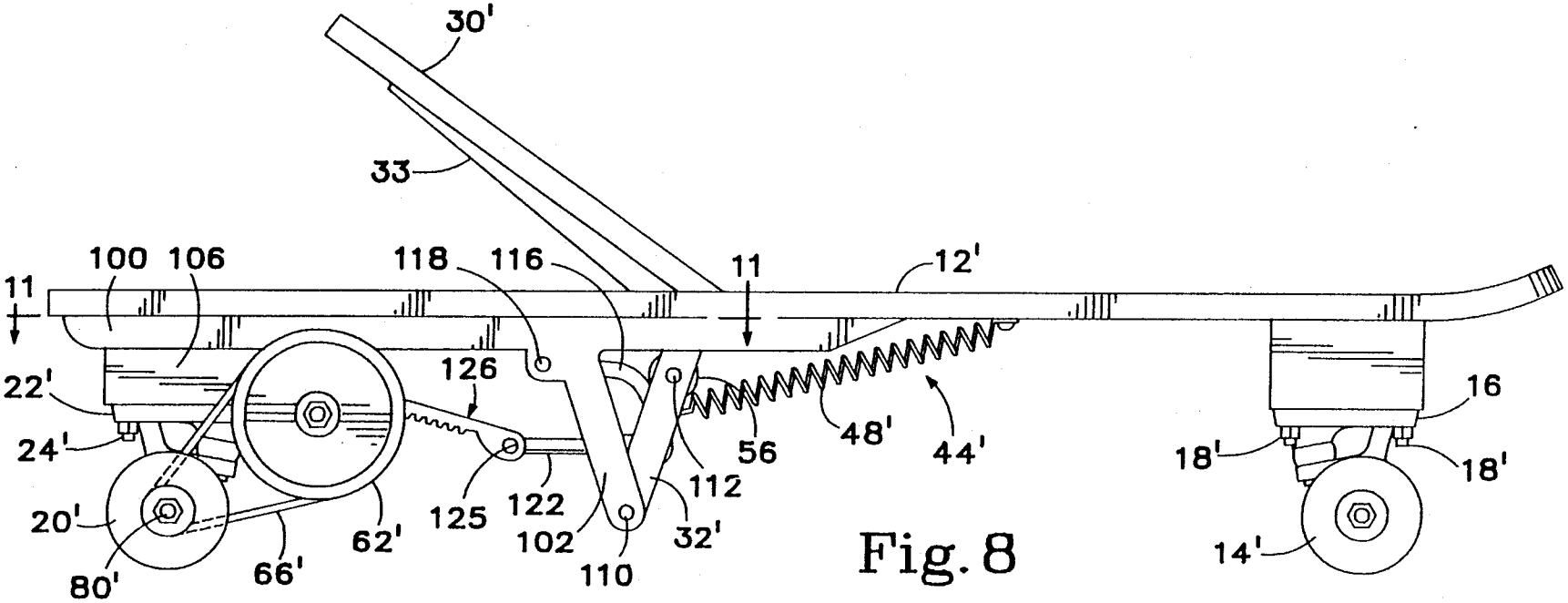
FIG. 8 is a side view of the pedal-powered skateboard shown in FIG. 7 with the transmission, spring return and steering shown in greater detail.
Figure 9:
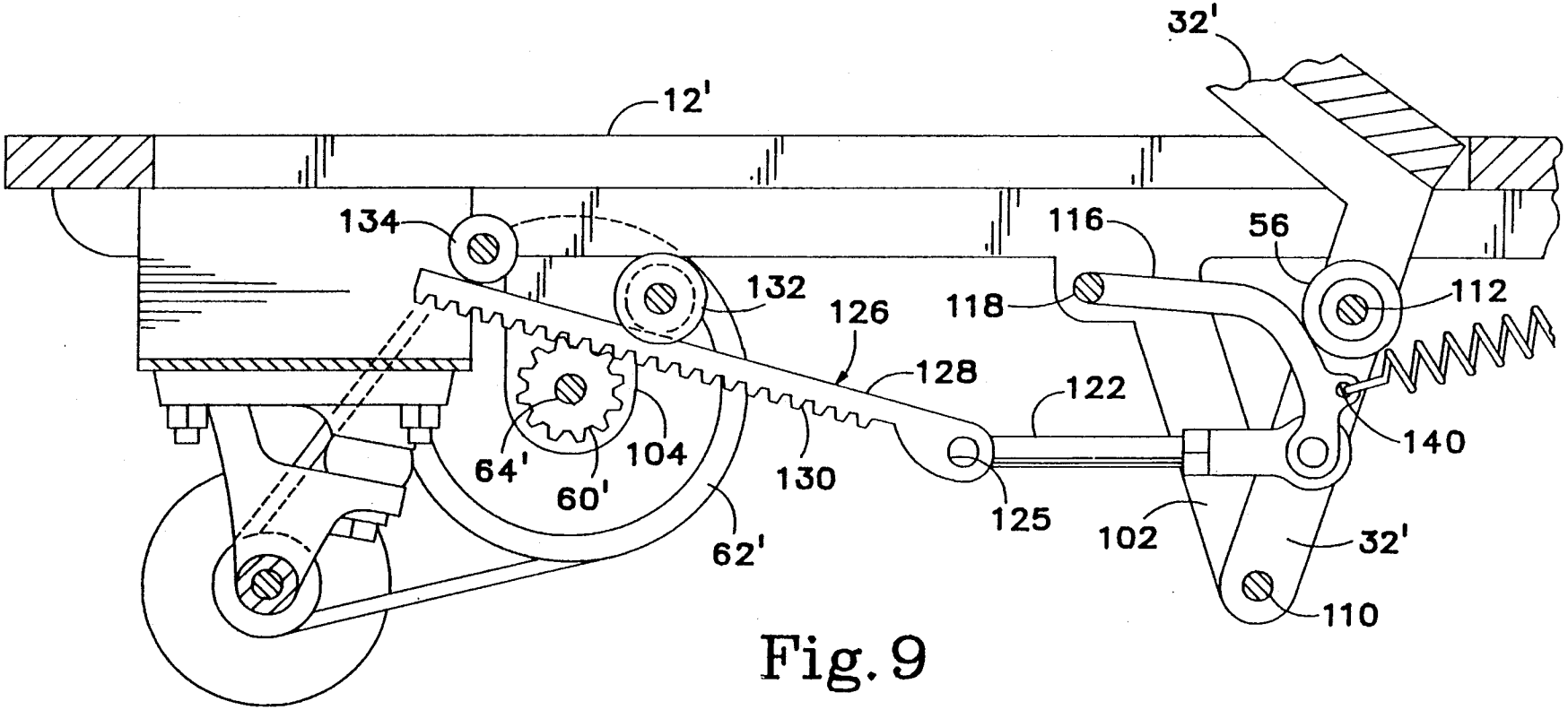
FIG. 9 is a partial sectional view taken along lines 9—9 of FIG. 7 and showing the transmission and spring return in still further detail.

Referring to FIG. 6, drive wheel assembly 82 is shown in an exploded view. Although only one of the front drive wheels 20 and one side of the front steering truck 22 are shown, FIG. 6 is representative of both drive wheel assemblies and both sides of the steering truck since they are symmetrical about a vertical plane through the lateral center of the truck. The drive wheel assembly 82 comprises drive wheel 20 which receives overrunning clutch member 76 in engaging relation thereto, e.g. pressed into the inner portion of the drive wheel. Overrunning clutch member 76 in turn receives cylindrical extension 78 of driver 72. The assembly 82 further includes bearings 86, spacer 88, a washer 90 and a locknut 92 for assembly in the relation indicated upon axle 80, with bearings 86 and the spacer 88 rotatably carrying the driver 72 such that the driver is free to spin with respect to the axle. As understood by those skilled in the art, clutch member 76 engages extension 78 as driver rotation is in a first direction (corresponding to forward movement of the skateboard) exceeds that of wheel 20.

Figure 2:
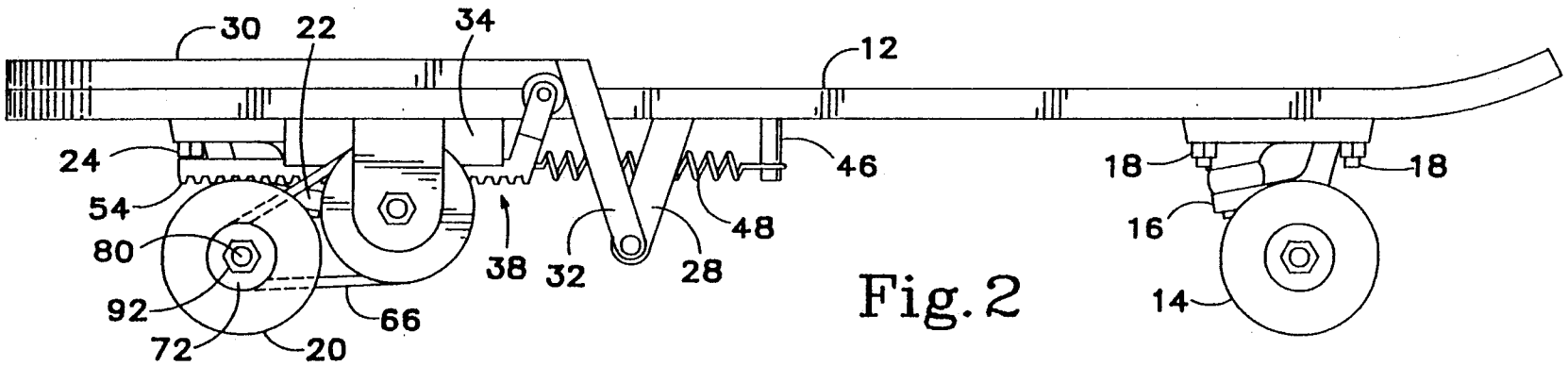
FIG. 2 is a side view of the pedal-powered skateboard of FIG. 1 showing the transmission, spring return and steering in more detail.
Figure 3:
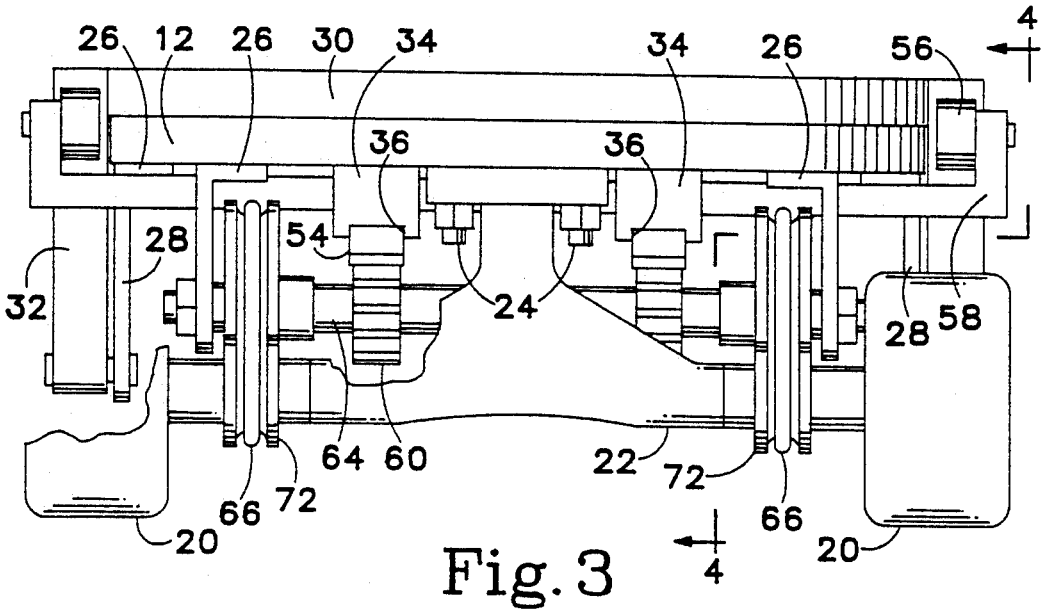
FIG. 3 is a front view of the skateboard with a portion of the front steering truck and a portion of a drive wheel broken away.

Referring again to FIG. 5, transmission means 38 comprises a reciprocable rack 50 which is preferably integrally made up of a generally wishbone or Y-shaped transverse member 52 and longitudinally extending toothed members 54. The toothed members 54 are parallel to each other and extend perpendicularly toward the front of the skateboard roughly equidistant from the center of Y-shaped transverse member 52. The toothed members 54 have gear teeth on their lower surfaces and are smooth on their upper surfaces for sliding within the grooves 36 of blocks 34. Pedal rollers 56 are rotatably mounted to the inside of upright portions 58 of Y-shaped transverse member 52 for rollably engaging pivotable pedal extensions 32 (FIGS. 2 and 4). Transmission means 38 further includes a pair of pinions 60 fixably mounted on a shaft 64 extending rotatably between frame brackets 42 of second frame 40 and with the pinions evenly spaced on the drive shaft and meshing with the gear teeth on the lower surfaces of toothed members 54. Transmission means 38 also includes pulleys 62 rotatably mounted near each end of the shaft 64 via clutch bearings 74 pressed in the inner portions of the pulleys, pinions 60 being spaced between the pulleys along the shaft so as to mate with toothed members 54. The transmission means also includes a pair of flexible belts 66, preferably of circular cross section and made of rubber, which interconnect each pulley 62 to a driver 72 and which are carried in grooves 68, 70 defined around the circumference of pulleys 62 and drivers 72. The belts extend on either side of the steering truck diagonal axis.

Upon depression of pedal 30, pedal rollers 56 which are engaged with upright portions 58 of Y-shaped transverse member 52 are pushed forwardly as the pedal rollers roll along an upper portion of the pivotable pedal extensions 32. This in turn drives Y-shaped transverse member 52 and integral horizontal toothed members 54 forwardly, causing the gear teeth of horizontal toothed members 54 to drive the meshed gear teeth of pinions 60 in a counterclockwise direction. Since the pinions are fixed to drive shaft 64, the pedal stroke also causes the drive shaft to rotate in a counterclockwise sense such that pulleys 62 carried on the drive shaft on overrunning clutch bearings 74 are driven in a counterclockwise direction. That is, overrunning clutch bearings 74 pressed within the inner portions of each pulley 62 and carried on shaft 64 permit each pulley 62 to be driven by the shaft in a forward (counterclockwise) direction during each downward pedal stroke. Belts 66 interconnecting the pulleys 62 and drivers 72 are also rotated to impart counterclockwise rotational motion to drive wheels 20 via clutch bearings 76. In other words, overrunning clutch bearings 76 (FIG. 6) which receive extensions 78 of drivers 72 and which are pressed within the inner portions of drive wheels 20, permit each wheel to be impelled by the drivers in a forward (counterclockwise) direction during each pedal stroke. When thus driven, drivers 72 rotate on bearings 86 on axle 80. When the skateboard is coasting along with, for example, the pedal in a depressed position, the overrunning clutch bearings 76 permit the wheels to continue to overrun without further actuation of the transmission means. Depression of pedal 30 and operation of transmission means 38 in this manner overcomes the force of spring 48 of spring return means 44 which, when the pedal is not depressed, normally biases both pedal 30 to an angled position with respect to deck 12 and reciprocable rack 50 to a ready position as shown in FIG. 4.

When the pedal is no longer depressed so as to overcome the force of spring 48, the spring recoils to its normal position pulling the Y-shaped transverse member 52 and pedal rollers 56 rearwardly whereby the pedal rollers again roll along the upper portion of pivotable pedal extensions 32 driving the pedal to its nondepressed position wherein the pedal forms an angle with deck 12 and wherein rack 50 is returned to a ready position as shown in FIG. 4. This recoil action of the spring 48 causes the teeth of members 54 to rotate pinions 60 (and therefore shaft 64) in a clockwise direction. However, since the pulleys 62 are rotatably mounted on the shaft via overrunning clutch bearings 74 which allow the pulleys to be driven in a counterclockwise direction but allow spinning or overrunning of the shaft relative to the pulleys in the clockwise direction, the pulleys generally do not rotate in a clockwise direction with the shaft. Rather, since drive wheels 20 are permitted to overrun on overrunning clutch bearings 76 as described above, drivers 72, belts 66, and pulleys 62 all remain stationary, both while the skateboard 10 is coasting along and when the pedal 30 and rack 50 are being returned to their ready positions by spring 48.

Inasmuch as the skateboard in accordance with the invention is supported on wheels 14 and 20 carried on generally conventional steering trucks 16 and 22, steering of the skateboard is accomplished in a usual manner, that is, the rider of the skateboard leans to either side of deck 12 laterally with respect to the forward motion of the skateboard such that the wheels 14, 20 are pivoted in opposing directions about diagonal steering axes 96 and 98 in a manner understood in the skateboard art. Since belts 66 are made of a flexible material (rubber in a preferred embodiment), they expand on the side of the turn upon which the distance between driver 72 and pulley 62 is increased to maintain a driving contact between that particular pulley and driver. Belts 66 are also drivingly connected between driver 72 and pulley 62 on the side of the turn wherein the distance between the driver and the pulley is decreased, and contract such that a positive driving relation is maintained between the pulley and the driver. Since belts 66 are of a circular cross section and are carried in grooves 68, 70 of pulleys 62 and drivers 72, respectively, the driving relationship between the pulleys and the driver is maintained during turns.

Moreover, a differential effect is produced with this system because as the distance between a driver 72 and its respective pulley 62 is increased, the tension in the belt 66 is increased and therefore a more positive drive relationship is established, whereas when the distance between the opposing driver 72 and pulley 62 on the opposite side of steering truck 22 is decreased, as is the case during a turn, the drive relationship between that driver and that pulley is loosened. In other words, to accommodate the differential speed of drive wheels 20 during a turn, the wheel on the inside of the turn spins slower than the wheel on the outside of the turn because the distance to be traveled by the inner wheel is less than the distance to be traveled by the outer wheel, and accordingly, the fact that driver 72 on the inside of the turn is moved closer to pulley 62 on the inside of the turn and thereby causes the tension in belt 66 to be slightly decreased, allows the wheel on the inside of the turn to roll at the appropriate speed even though the turn may be executed during a pedal stroke. Conversely, the fact that driver 72 on the outside of the turn is moved a greater distance from pulley 62 on the outside of the turn, causing the tension in belt 66 between that particular driver and pulley to increase, accords with the need for that drive wheel to have a greater speed as would be achieved due to the fact that the drive relationship between that driver and that pulley would not be as subject to slippage. Since, preferably, there are no teeth on belts 66, all of the rotational force of the pulley is not transmitted to drive wheels 20; rather there exists some slippage between the belts. and drivers 72 and pulley 62.

Figure 1:
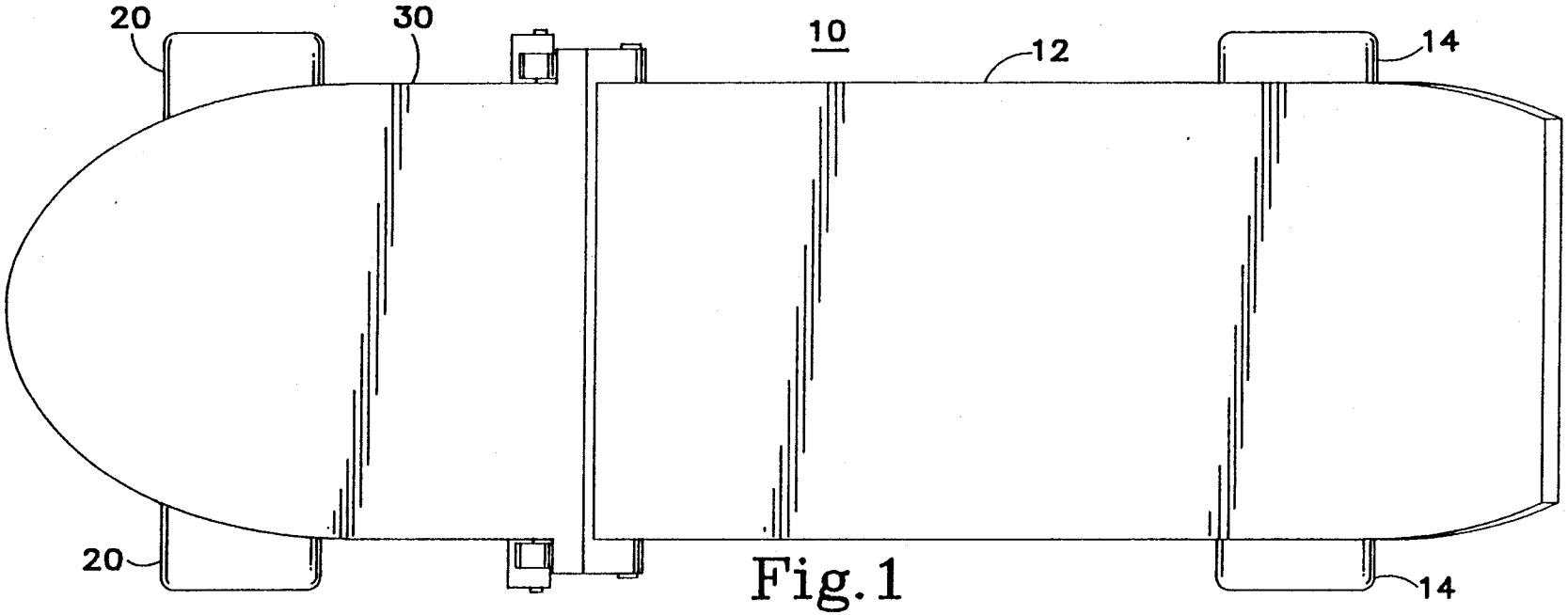
FIG. 1 is a top view of a pedal-powered skateboard in accordance with one embodiment of the invention showing the pedal depressed.

Also, as can be seen in FIGS. 1 and 2, the rear portion of the deck 12 is curved upwardly to provide a location for the rider's foot as necessary to perform "wheelie" maneuvers. Furthermore, it will be apparent that the functioning of the steering trucks 16, 22 during a turn, and likewise operation of the rotatable mounting of the free spinning rear wheels 14, are matters known to one of ordinary skill in the art such that a detailed description of their function is not necessary to the completeness of this disclosure.

As can be seen in FIGS. 2 and 4, pedal 30 is pivoted to lowermost portions of brackets 28 a substantial distance below the surface of deck 12. This has the effect of increasing the length of the pedal and thereby increasing the leverage achieved by depressing the pedal out near its distal end, without requiring that the pedal be raised unduly above the deck which would cause the skateboard to be unstable when the pedal is in the ready position. Also, this serves to lower the center of gravity of the skateboard, adding to its stability.

Referring now to FIGS. 7–11, a second embodiment of the invention is shown wherein pedal 30' has been "cut out" of deck 12, instead of the pedal overlapping the deck as in the first embodiment of the invention. Also, the transmission means of the second embodiment of the invention is significantly different from the transmission means of the first embodiment; likewise pivotable pedal extensions 32' and pedal rollers 56' are somewhat different from those in the first embodiment.

Like the first embodiment, the skateboard 10' comprises an elongated deck 12' for supporting the feet of the rider; a pair of free spinning rear wheels 14' rotatably mounted on a diagonal axis rear steering truck 16', steering truck 16' being fixedly mounted to the underside of the deck with nut and bolt combinations 18'; and a pair of front drive wheels 20' rotatably mounted to axles 80' of diagonal axis front steering truck 22' in the manner shown and described in connection with FIG. 6, steering truck 22' being fixably mounted to the underside of the deck with nut and bolt combinations 24'. Unlike the first embodiment of the invention, a single frame 100 is mounted to the underside of deck 12', the frame having a pair of downwardly extending pedal mounts 102, a pair of vertically downwardly extending transmission mounts 104 and an open ended box shaped front truck mount 106, all preferably integral with the frame and positioned below the deck.

Referring to the differences between the pivotable pedal extensions 32' of the second embodiment as compared to the first embodiment pedal extensions 32, pedal extensions 32' extend from a pedal support member 33 underlying pedal 30' and are mounted thereto, pivotal pedal extensions 32' extending nearly perpendicularly to pedal support member 33 and downwardly through an opening 108 in the surface of deck 12' to a position substantially below the surface of the deck where pivotal pedal extensions 32' are pivotally connected to the downwardly extending pedal mounts 102 at a point 110. The pivotal pedal extensions 32' of the second embodiment are unlike pivotal pedal extensions 32 of the first embodiment in that they are closer together near the longitudinally extending centerline of the pedal than those of the first embodiment wherein extensions 32 straddle the outsides laterally of deck 12.

Also, unlike the first embodiment of the invention, pedal rollers 56 are positioned immediately adjacent each other (in fact, a single pedal roller 56 may be used) being rotatably carried on a roller shaft 112 and retained from lateral displacement along the roller shaft by snap rings.

This revised pedal extension and pedal roller construction accommodates transmission means 38' structure as shown in FIGS. 7–11. Referring to transmission means 38' of the second embodiment of the invention, a curved cam member 116 is pivotally retained on a laterally extending cam member shaft 118 extending between the two longitudinal members 101 of frame 100 at a distance slightly forward of pivot point 110 between pivotal pedal extensions 32' and the downwardly extending pedal mounts 102. The cam member 116 is pivotally retained on cam member shaft 118 with a laterally extending sleeve defined within the foremost and uppermost end of the cam member and is slidably carried on the cam member shaft with lateral spacing sleeves 120 being carried on the cam member shaft on either side of the cam member and between longitudinal members 101 of frame 100 for maintaining the cam member appropriately aligned near the longitudinal center of the skateboard.

Pivotally connected to the other end of cam member 116 is a T-shaped linkage member 122. The bottom of T-shaped linkage member 122 is pivotally connected to the lower end of cam member 116 as described above, and the T-bar portion 124 of linkage member 122 is pivotally retained in openings 125 defined in the ends of linear reciprocable toothed members 126. Like linear toothed members 54 of the first embodiment, linear reciprocable toothed members 126 are positioned parallel to one another and reciprocate linearly and simultaneously during pedal strokes and pedal returns, toothed members 126 having a smooth upper surface 128 and a toothed lower surface 130. However, the smooth upper surface 128 of toothed members 126, unlike the smooth upper surfaces of toothed members 54, rollably engage guide rollers 32, 134. That is, each reciprocable toothed member 126 engages a pair of guide rollers 132, 34, there being a total of four guide rollers. Guide rollers 132 have circumferential retaining rings for maintaining the smooth upper surfaces 128 of the linear reciprocable toothed members 126 in line and on track on the guide roller path. In a manner similar to the first embodiment, the gear teeth of toothed lower surface 130 mesh with corresponding gear teeth of pinions 60' fixedly carried on drive shaft 64' that extends laterally of the deck 12' and is rotatably carried in the vertically downwardly extending transmission mounts 104. Pulleys 62' having overrunning clutch bearings 74' pressed within the inner portions of the pulleys are rotatably carried on the clutch bearings on the ends of the transmission mounts 104, the pulleys being retained on the shaft 64' with a heavy washer and cotter pin. The rest of the transmission means is substantially similar to that of the first embodiment, with belts 66' interconnecting pulleys 62' with drivers 72', the belts being carried in semicircular grooves 68' and 70' around the circumference of each of the pulleys and drivers. As for the description of the drive wheel assembly 82 discussed above in connection with FIG. 6, the same drive wheel assembly discussion applies to the drive wheels 20' of the second embodiment.

The spring return means 44' is slightly different from that of the first embodiment in that a spring 48' is connected at one end to cam member 116 near the interconnection between the cam member and T-shaped linkage member 122, the spring being hooked through an eye 140 formed in the cam member. The other end of spring 48' is mounted to the underside of deck 12' with a screw 142 passing through a loop in the end of the spring.

The operation of the second embodiment involves depression of pedal 30 such that pivotal pedal extensions 32' pivot about their pivot points 110 and such that pedal rollers 56' engage cam member 116 and displace the cam member pivoting it about cam member shaft 118 and such that T-shaped linkage member 122 pivoted to the opposing end of the cam member is driven generally forwardly, but with some pivoting motion, the linkage member driving linear reciprocable toothed members 126 linearly forwardly, but at a slight incline within the paths defined by guide rollers 132, 134 and pinions 60'. Thus, toothed lower surfaces 130 of toothed members 126 drive pinions 60' in a counterclockwise manner, the pinions being fixed to the shaft such that clutch bearings 74' retained in the pulleys drive the pulleys which in turn drive belts 66' and drivers 72' retained on clutch bearing 76 that are engaged in a counterclockwise direction to drive the drive wheels 20'. Then upon releasing pressure from pedal 30', spring return means 44' biases cam member 116 to its ready position which in turn pulls toothed rack members a 126 rearwardly over pinions 60' to their ready position. As described in connection with the first embodiment of the invention, this returning of the pedal to a raised position and returning toothed rack members 126 to their ready position does not drive the pulleys or the drivers of the transmission means 38' in a reverse direction, since both the drivers and the pulleys are carried on clutch bearings which overrun and do not engage during clockwise rotation.

Figure 10:
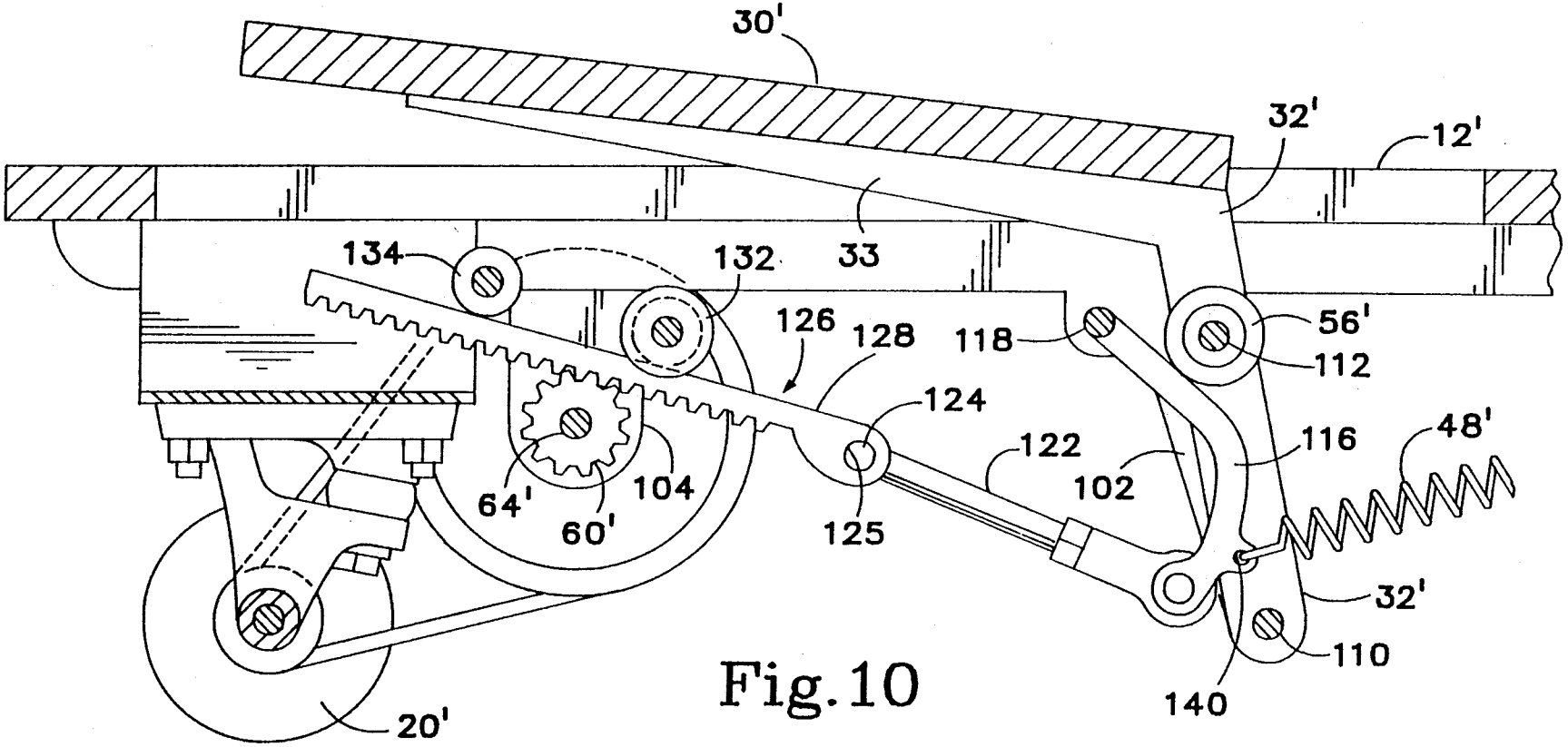
FIG. 10 is a partial sectional view taken along lines 9—9 of FIG. 7 with the pedal partially depressed, illustrating the positioning of the transmission during a pedal stroke.
Figure 11:
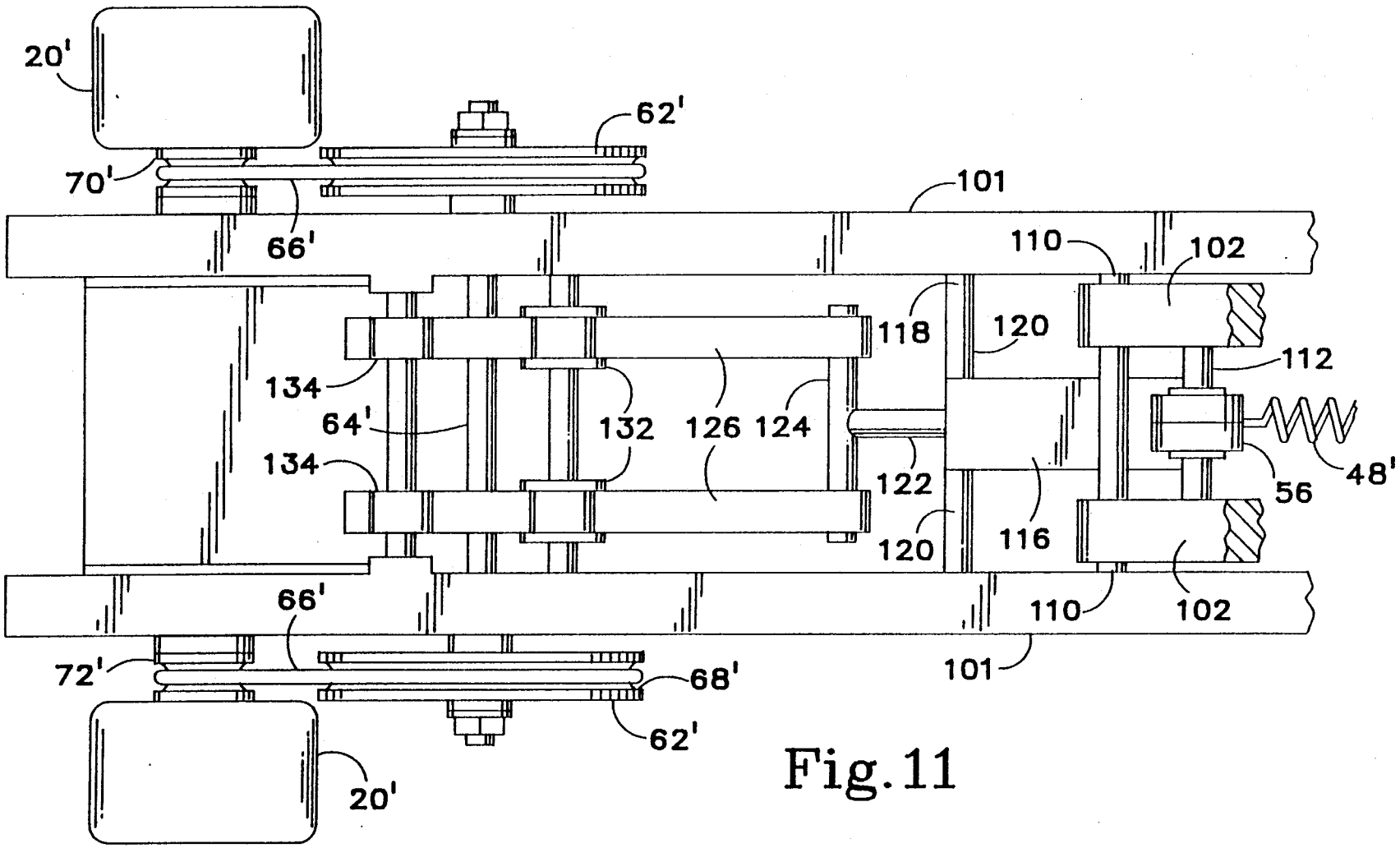
FIG. 11 is a partial section view of the skateboard transmission taken at 11—11 in FIG. 8.

An added advantage of transmission means 38' is that pedal rollers 56' roll along a cammed surface of member 116 such that a variable response is encountered during depression of the pedal to vary the output of a pedal stroke along the stroke. The pedal rollers 56', upon approaching the bottom of a pedal stroke, move closer and closer to the pivoting location of the cam member at cam member shaft 118 and in so doing accomplish greater output in terms of velocity of linkage member 122 and hence toothed rack members 126 during the lowermost portion of the pedal stroke. This, of course, provides greater speed output during the lower portion of the pedal stroke whereby higher speeds may be reached and/or maintained by simply allowing the pedal to raise a relatively small amount, for example as shown in FIG. 10, and repeatedly depressing the pedal throughout this shortened range of motion. Moreover, output speed increases as the pedal is pivoted closer to the deck 12' such that higher speeds may be attained with the pedal remaining in this lower, more stable position with respect to the rest of the deck.

The advantages of the first embodiment with respect to harmonization of the steering of the drive wheels with conventional steering trucks and transmission means 38' are also achieved with the second embodiment of the invention, since belts 66' are of circular cross section and are carried in the semicircular grooves 68', 70' of pulleys 62' and drivers 72' on either side of the truck steering axis. Thus, a positive drive is maintained without interference with steering.

Another aspect of the second embodiment of the invention is that the forward steering truck 22' is mounted to a box shaped front truck mount 106 which extends downwardly from frame 100 and which is open ended whereby toothed rack members 126 may be reciprocated freely above the trucks and within the confines of the mount. Of course it will be appreciated that toothed members 126 may reciprocate along either side of steering truck 22' as in the case of the first embodiment of the invention.

It will be appreciated that the embodiments of the present invention are also adapted to implementation as conversions of already existing skateboards. Thus, a frame or frames as described hereinabove can be mounted to an existing skateboard, a said frame carrying a pedal member. The wheel trucks are suitable also modified and an opening or the like may be provided to receive the pedal. The modifications can be provided in kit form.

While plural embodiments of the present invention have been shown and described, it will be apparent to those skilled in the art that many other changes and modifications may be made without departing from the invention in its broader aspects. The appended claims are therefore intended to cover all such changes and modifications as fall within the true spirit and scope of the invention.

We claim:

1. A skateboard comprising:

an elongated deck;

a pedal pivotally mounted with respect to said deck and pivotable between a first ready position and a second depressed position;

a plurality of wheels rotatably mounted on the underside of said deck for supporting said each on a surface including at least one drive wheel retaining a clutch bearing;

transmission means interposed between said pedal and said at least one drive wheel such that movement of said pedal from said pedal's first ready position to said depressed position causes said drive wheel to rotate and move said skateboard along said surface, said transmission means including a rack;

spring return means for biasing said rack toward a first position when said pedal is not depressed; and a frame member fixedly mounted to and extending downwardly from said deck, said pedal being pivotally mounted to said frame member at a location a substantial distance below said deck;

wherein said rack comprises at least one horizontally disposed member having an upwardly facing slidable portion that slides within a groove in a block mounted to the underside of said deck and a downwardly facing toothed potion for meshing with and driving a pinion rotatably mounted to a frame member fixedly mounted to and extending downwardly from said deck, said pinion driving a pulley rotatably mounted to a said frame member, said pulley driving said drive wheel for propelling said drive wheel, and wherein said rack has a roller at one end thereof of rollably engaging said pedal.

2. A skateboard in accordance with claim 1 wherein said pulley is operably connected to said drive wheel by a flexible belt of substantially circular cross section.

3. a skateboard comprising:

an elongated deck;

a pedal pivotally mounted with respect os said deck and pivotable between a first ready position and a second pressed position;

a plurality of wheels rotatably mounted on the underside of said deck for supporting said deck on a surface including at least one drive wheel retaining a clutch bearing;

transmission means interposed between said pedal and said at least one drive wheel such that movement of said pedal from said pedal's first ready position to said depressed positions causes said drive wheel to rotate and move said skateboard along said surface, said transmission means including a rack;

spring return means or biasing said rack toward a first position when said pedal is no depressed; and a frame member fixedly mounted to and extending downwardly from said each, said pedal being pivotally mounted to said frame member at a location a substantial distance below said deck;

said skateboard further comprising a second drive wheel, and wherein said rack comprises a pair of horizontally disposed interconnected members having upwardly facing slidable portions that slide within grooves in block means mounted to the underside of said deck and downwardly facing toothed portions for meshing with and driving pinions rotatably mounted to a frame fixedly mounted to and extending downwardly from said neck, said pinions driving pulleys having clutch bearings therein and rotatably mounted to said frame, said pulleys being operably connected to said drive wheels or propelling said drive wheels, and wherein said rack has rollers at one end thereof for rotatably engaging sad pedal.

4. A skateboard in accordance with claim 3 wherein said pulleys drive respective drive wheels by flexible belts of substantially circular cross section.

5. The skateboard of claim 4 wherein the skateboard is steered by conventional trucks having opposing diagonal steering axes, said flexible belts extending on either side of one of said steering axes.

6. A skateboard comprising:

an elongated deck;

a pedal pivotally mounted with respect so said deck and pivotable between a first ready position and a second depressed position;

a plurality of wheels rotatably mounted on the underside of said deck for supporting said deck on a surface including at least one drive wheel retaining a clutch bearing;

transmission means comprising a linearly reciprocable rack movable substantially horizontally with respect to said deck between a first ready position and a second driven position, said rack being operably engaged between said pedal and said at least one drive wheel such that movement of said pedal from said pedal's first ready position to said depressed position cause said rive wheel to rotate and move said skateboard along said surface, and a plurality of rollers supported from said skateboard, said rack being longitudinally rollable within said rollers;

spring return means of biasing said rack toward its first position when said pedal is not depressed; and a frame member fixedly mounted to and extending downwardly from said deck, wherein said pedal is pivotally mounted to said frame member at a location a substantial distance below said deck.

7. A skateboard in accordance with claim 6 wherein said rack is reciprocated by a mechanical linkage including camming mean as one of the links of said linkage, wherein said camming mean id displaced such that during the latter portion of a pedal stroke, increased velocity is imparted to said rack.

8. In a skateboard adapted for pedal operation, at least one frame for mounting to the underside of said skateboard so as not to interfere with the operation of conventional type steering trucks of said skateboard;

block means having grooves therein and adapted for mounting to the underside of said skateboard;

a pedal pivotally mounted to said frame and pivotably between a first ready position and a second depressed position;

a drive wheel adapted for replacing a conventional skateboard wheel, said drive wheel having a clutch bearing pressed therein and a driver operably connected to said clutch bearing;

transmission means comprising a linearly reciprocable rack slidable within said grooves in said block means and toothed of driving a pinion rotably mounted to said frame said pinion driving a pulley mounted to said frame and which has a clutch bearing therein, said pulley driving said driver of said rive wheel with a flexible loop provided between said pulley and said driver, said rack having a roller at one end thereof for engaging said pedal such that pivoting said pedal between said first and second positions causes said rack to slide with said grooves to transmit power via said pinion, pulley and flexible loop to said driver of said drive wheel for propelling said skateboard; and spring return means or biasing said rack to a position ready for a subsequent pedal stroke and or biasing said pedal to said first ready position.

9. A skateboard in accordance with claim 8 wherein said rack is interrelated with said pedal by camming means.

10. In a skateboard adapted or pedal operation, at least one frame for mounting to the underside of aid skateboard so as not to interfere with the operation of conventional skateboard steering trucks;

a plurality of rollers adapted for being mounted to said frame and on the underside of said skateboard;

a pedal pivotally mounted to said frame and pivotable between a first ready position and a second depressed position;

a drive wheel adapted for replacing a conventional skateboard wheel, said drive wheel having a clutch bearing pressed therein and a driver operably connected to said clutch bearing;

transmission means comprising a linearly reciprocable rack rollable within said plurality of rollers and toothed for driving a pinion rotatably mounted to said frame, said pinion driving a pulley mounted to said frame and which has a clutch bearing therein, said pulley driving said driver of said drive wheel with a flexible loop provided between said pulley and said driver, said rack being operably engaged with said pedal by a mechanical linkage having a cammed surface as one link of said linkage and a roller engaging said cammed surface such that pivoting said pedal from said first position to said second position causes said rack to reciprocate on said plurality of rollers and transmit power via said pinion, pulley and flexible loop to said driver of said drive wheel for propelling said skateboard; and spring return means for biasing said rack to a position ready for a subsequent pedal stroke and for biasing said pedal to said first ready position.

* * * * *

UNITED STATES PATENT AND TRADEMARK OFFICE
CERTIFICATE OF CORRECTION

PATENT NO. : 5,224,719

DATED : July 6, 1993

INVENTOR(S) : Byron L. Goodspeed

It is certified that error appears in the above-identified patent and that said Letters Patent is hereby corrected as shown below:

On the cover sheet, [57] ABSTRACT, line 20, "member" should read --means--.

Column 11, line 36, "each" should read --deck--.

Column 11, line 56, "potion" should read --portion--.

Column 11, line 63, "of" should read --for--.

Column 12, line 1, "os" should read --to--.

Column 12, line 3, "pressed" should read --depressed--.

Column 12, line 11, "positions" should read --position--.

Column 12, line 15, "or" should read --for--.

Column 12, line 16, "no" should read --not--.

Column 12, line 18, "each" should read --deck--.

Column 12, line 30, "neck" should read --deck--.

Column 12, line 33, "or" should read --for--.

Column 12, line 35, "sad" should read --said--.

Column 12, line 45, "so" should read --to--.

UNITED STATES PATENT AND TRADEMARK OFFICE

CERTIFICATE OF CORRECTION

PATENT NO. : 5,224,719

DATED : July 6, 1993

INVENTOR(S) : Byron L. Goodspeed

It is certified that error appears in the above-identified patent and that said Letters Patent is hereby corrected as shown below:

Column 12, line 60, "cause" should read --causes--; and "rive" should read --drive--.

Column 13, line 6, "id" should read --is--.

Column 13, line 18, "pivotably" should read --pivotable--.

Column 13, line 27, "of" should read --for--; and "rotably" should read --rotatably--.

Column 13, line 32, "rive" should read --drive--.

Column 13, line 36, "with" should read --in--.

Column 14, line 2, "or" should read --for--.

Column 14, line 7, "or" should read --for--.

Column 14, line 9, "aid" should read --said--.

Signed and Sealed this

Third Day of May, 1994

Bruce Lehman

*Attest:*

BRUCE LEHMAN

*Attesting Officer*

*Commissioner of Patents and Trademarks*